United States Patent [19]

Vian

[11] 3,970,289

[45] July 20, 1976

[54] VARIABLE RATE OPPOSING ROTATIONAL MIXER AND FEEDER

[75] Inventor: Joel Dimas Vian, Passaic, N.J.

[73] Assignees: Joseph Rich, Jr., East Rutherford; Adolf Alvarez, Passaic, both of N.J. ; part interest to each

[22] Filed: Oct. 21, 1974

[21] Appl. No.: 516,652

[52] U.S. Cl. ..... 259/103

[51] Int. Cl.[2] ..... B01F 7/02

[58] Field of Search..... 259/3, 105, DIG. 27, 259/DIG. 28, DIG. 1

[56] References Cited

UNITED STATES PATENTS

| | | | |
|---|---|---|---|
| 1,247,655 | 11/1917 | Frame | 259/105 |
| 2,099,937 | 11/1937 | Lauterbur | 259/DIG. 1 |
| 2,298,317 | 10/1942 | Smith | 259/105 X |
| 2,972,168 | 2/1961 | Pastorello | 259/105 X |
| 3,215,412 | 11/1965 | Kindler | 259/105 X |
| 3,452,965 | 7/1969 | Leister | 259/105 X |

*Primary Examiner*—Stanley N. Gilreath
*Assistant Examiner*—Donald B. Massenberg
*Attorney, Agent, or Firm*—Silverman and Jackson

[57] ABSTRACT

The present invention constitutes a mixing and feeding apparatus for use in association with solid chemicals such as fiberglass and certain plastics. The mixing function is achieved by a circumferential tumbler, having a plurality of longitudinal prongs, which rotates in a first direction. Concurrently with the rotation of the tumbler, an axial flight screw, axially disposed within the tumbler, rotates in an opposite direction. The rotation of the flight screw interacts with the tumbler to perform a mixing function while also serving to advance the solid material from the mixer to a discharge area.

5 Claims, 7 Drawing Figures

VARIABLE RATE OPPOSING ROTATIONAL MIXER AND FEEDER

BACKGROUND OF THE INVENTION

The present invention relates to mixing and agitating devices and, more particularly, to rotating stirrers having two fixed axes of motion.

The present invention represents an effort to apply certain mixing concepts which, at a rudimentary level, have existed in that area of the prior art which relate to the agitation and mixing of various foods. For example, the patents to Bradburn, U.S. Pat. No. 306,465 (1884) and to Nelson, U.S. Pat. No. 928,397 (1909) disclose devices for the mixing of cream, bread batter and other homogenous materials.

In addition to its mixing function, the present invention performs an important feeding operation. That is, in addition to mixing and agitating the materials of interest, the advancement of such materials, after they have been mixed, away from the agitating elements, is herein facilitated.

SUMMARY OF THE INVENTION

An object of the present invention is to provide an improved means for the mixing and agitating of solid materials.

Another object is to provide a combined mixing and feeding apparatus.

A further object is to provide an apparatus capable of mixing materials at one speed while discharging the materials at a second speed wherein both the rate of mixing and the rate of discharge are independently adjustable.

A yet further object is to provide a mixing apparatus having two respectively fixed axes of agitation in which the angular rotations of each about said axis are in mutual opposition.

DETAILED DESCRIPTION OF THE INVENTION

Figure 1:
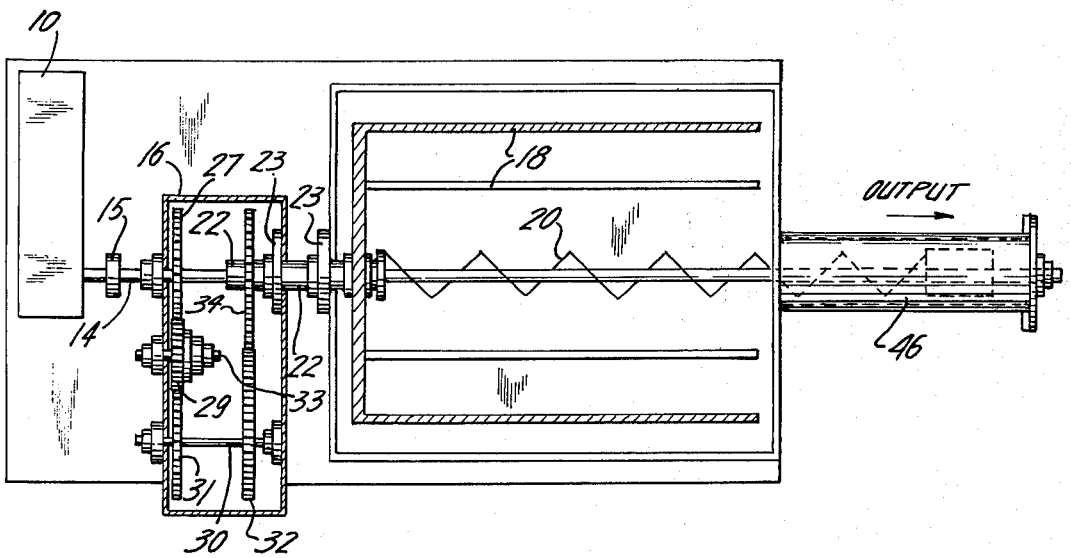
FIG. 1 is a top view of the present invention.
Figure 2:
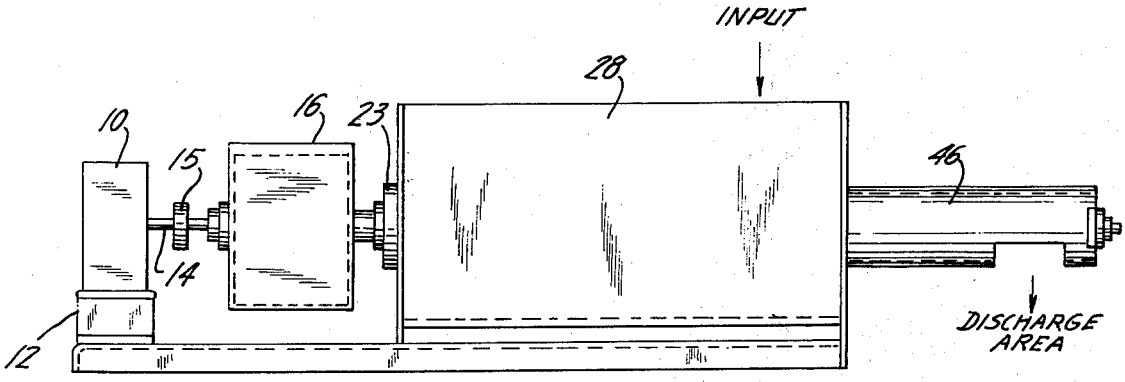
FIG. 2 is a side view of the present invention.
Figure 3:
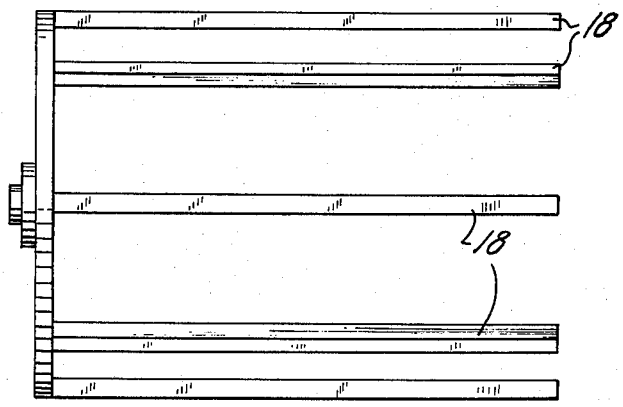
FIG. 3 is a side view of the tumbler.

Shown in FIGS. 1 and 2 is a motor 10 which may be either an AC vari-drive motor or a DC motor. The motor has a self-supporting base 12 and turns preferably in a clockwise direction.

Said motor 10 actuates a drive shaft 14 which includes thereon a roller chain coupling 15 which serves to effectively connect the motor to the transmission box 16.

Within the transmission box 16 there exists a gearing mechanism, to be hereinafter described, which serves to rotate a tumbler 18 in a counterclockwise direction while rotating a solid flight screw 20 in a clockwise direction. This function is achieved in the following manner: the drive shaft 14 passes through a tumbler drive tube assembly 22, through the transmission box 16 and through to the solid flight screw 20, the axial center of which is an extension of the said drive shaft.

The drive shaft is axially secured inside the drive tube assembly 22, through the use of bearings 36, inside said assembly 22, and a bolt flange combination 23, outside tube assembly 22. The flange combination 23 is secured both inside of the transmission box 16 as well as outside of a mixing box 28. Within the box 28, the tumbler 18 and solid flight screw 20 perform their mixing functions.

A drive gear (first gear) 27 drives an idler gear (second gear) 29 and an idler shaft 33, in association with a parallel shaft 30. The shaft 30 exhibits third and fourth gears 31 and 32. Gear 31 serves to interlink the parallel shaft 30 with the idler gear 29 in order to achieve a reversal in direction of the rotation of the parallel shaft with respect to the direction of rotation of the drive shaft.

The fourth gear 32 acts to drive a fifth gear 34. This gear surrounds the tumbler drive tube assembly 22 which in turn advances the tumbler 18 in a counterclockwise direction.

Figure 5:
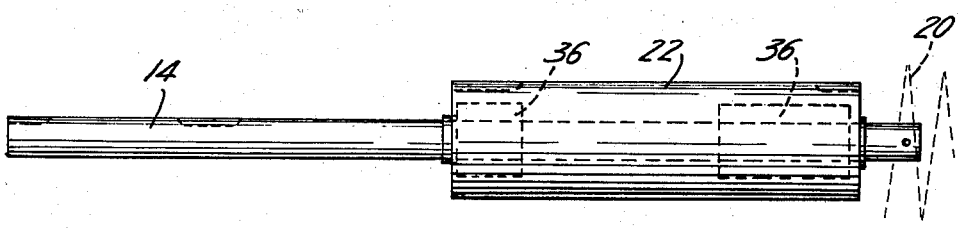
FIG. 5 is a side view of the tumbler drive tube assembly.
Figure 6:
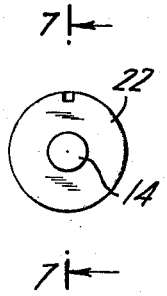
FIG. 6 is a front view of FIG. 5.
Figure 7:
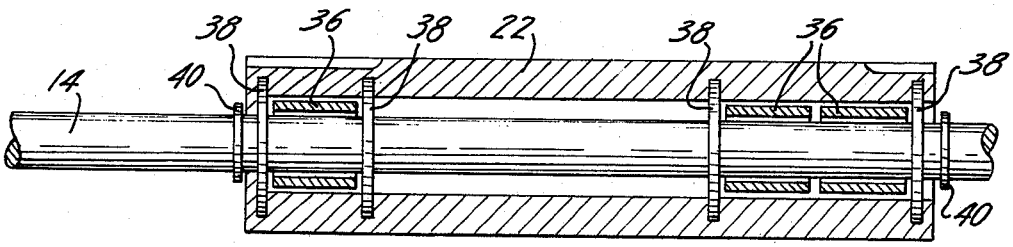
FIG. 7 is a cross-sectional longitudinal view taken along Line 7—7 of FIG. 6.

The tumbler drive tube assembly 22 is illustrated in further detail in FIGS. 5, 6 and 7. In FIGS. 5 and 7 it may be noted that the drive shaft 14 is surrounded by three clutch-type roller bearings 36. The roller bearings 36 are secured between two pairs of inner retaining rings 38. Circumferentially secured about said retaining rings and clutch bearings is the tumbler drive tube proper, denoted as element 22. The tumbler drive tube is held in place through a pair of outer retaining rings 40.

Figure 4:
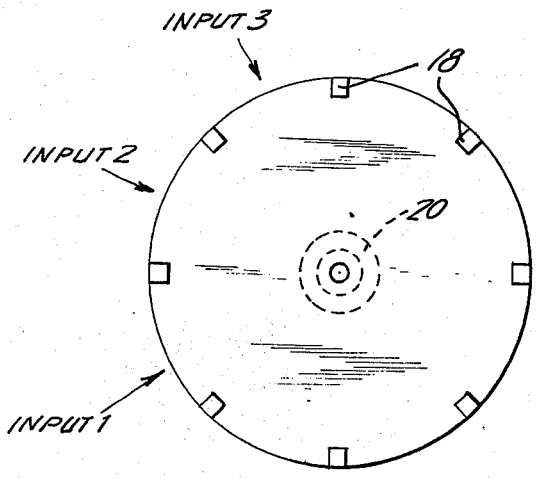
FIG. 4 is a front view of the tumbler of FIG. 3.

Turning now to FIG. 4, it may be seen that various solid chemical inputs may be fed between longitudinal prongs of the tumbler 18. These inputs are fed into the mixing box in a radial direction so that a maximum degree of churning by the prongs of the tumbler will occur.

It is to be noted that through the use of different gearing arrangements, all of which are well known in the art, the rate or rotation of either or both the tumbler 18 and the solid flight screw 20 may be selectably adjusted. Such adjustments may be desirable in the mixing of solid materials having particular properties.

It is to be emphasized that through the present use of two opposing rotations, one axial in nature, and the other circumferential, a mixing and churning function, more thorough than any heretofore known in the art, has been attained.

In addition to the mixing function, the solid flight screw 20 serves to feed or discharge the mixed material out of the mixing box 28 and into a discharge cylinder 46. In other words, no additional elements are needed in order to effectuate the discharge function of the present mixer. Also, the rate of discharge can be adjusted through appropriate changes in the gearing mechanism.

It is to be appreciated that changes in the configuration of the tumbler 18 and flight screw 20 can be made without in any way departing from the spirit and scope of the present invention.

Accordingly, it is seen that the objects enumerated in the Summary of the Invention have been efficiently attained by the above-described embodiments of the present invention. While there have been herein shown and described the preferred embodiments of the invention, it will be understood that said invention may be embodied otherwise than as herein specifically illustrated or described and that within said embodiments certain changes in detail and construction, and the form and arrangements of the parts, may be made without departing from the underlying idea or principles of this invention within the scope of the appended claims.

Having thus described my invention, what I claim as new, useful and non-obvious and, accordingly, secure by Letters Patent of the United States is:

1. A variable rate opposing rotational material mixer and feeder, comprising:

a. a mixing box having a longitudinal axis and containing a solid flight screw and a circumferential tumbler mixing element said solid flight screw being disposed along said longitudinal axis;

b. motor and gear drive means including means for axially rotating said flight screw in a given direction of angular rotation;

c. mid circumferential tumbler mixing element being disposed coaxially with and circumferentially about as said solid flight screw;

d. said motor and gear drive means for axially rotating said circumferential tumbler, in an angular direction opposite to the direction of rotation of said flight screw integrally surrounding said means for axially rotating said flight screw;

e. said flight screw serving to convey materials mixed in said mixing box by said mixing tumbler continuously through a communicating discharge cylinder extending coaxially from said mixing box to discharge outlet whereby the opposing rotations of said tumbler and said flight screw cause both an improved simultaneously mixing and discharging of said materials.

2. The apparatus as recited in claim 1 in which said tumbler comprises a plurality of longitudinal prongs.

3. The apparatus as recited in claim 1 in which said flight screw comprises an endless helical screw, whereby the rotation of said screw effectuates the axial advancement and discharge of the mixed materials.

4. The apparatus as recited in claim 1 in which said tumbler rotation means further comprises a variable speed control.

5. The apparatus as recited in claim 1 in which said flight screw rotation means further comprises a variable speed control.

* * * * *